United States Patent [19]

Haddow

[11] Patent Number: 4,792,098

[45] Date of Patent: Dec. 20, 1988

[54] IMPROVED IMPACT PLATE GRINDING MILL HAVING REDUCED MILLING GAS CONSUMPTION

[75] Inventor: Andrew J. Haddow, Cleveland, England

[73] Assignee: Tioxide Group PLC, London, England

[21] Appl. No.: 104,985

[22] Filed: Oct. 6, 1987

[30] Foreign Application Priority Data

Nov. 29, 1986 [GB] United Kingdom ..... 8628586

[51] Int. Cl.[4] ..... B02C 19/06

[52] U.S. Cl. ..... 241/5; 241/29; 241/40; 241/152 R

[58] Field of Search ..... 241/5, 39, 40, 152 R, 241/24, 29, 79.1

[56] References Cited

U.S. PATENT DOCUMENTS

| | | | |
|---|---|---|---|
| 253,444 | 2/1882 | Chichester | 241/40 |
| 4,018,388 | 4/1977 | Andrews | 241/39 |
| 4,504,017 | 3/1985 | Andrews | 241/40 |

FOREIGN PATENT DOCUMENTS

| | | | |
|---|---|---|---|
| 2738980 | 3/1979 | Fed. Rep. of Germany | 241/40 |
| 1076141 | 2/1984 | U.S.S.R. | 241/40 |
| 533015 | 2/1941 | United Kingdom . | |
| 592967 | 10/1947 | United Kingdom . | |
| 634723 | 3/1950 | United Kingdom . | |
| 645146 | 10/1950 | United Kingdom . | |
| 667763 | 3/1952 | United Kingdom . | |
| 671580 | 5/1952 | United Kingdom . | |
| 785679 | 10/1957 | United Kingdom . | |
| 1411369 | 10/1975 | United Kingdom . | |
| 2045642 | 11/1980 | United Kingdom . | |
| 2091127 | 7/1982 | United Kingdom . | |
| 2111855 | 7/1983 | United Kingdom . | |

*Primary Examiner*—Mark Rosenbaum

*Attorney, Agent, or Firm*—Banner, Birch, McKie & Beckett

[57] ABSTRACT

The invention relates to an improved mill that achieves excellent milling with a reduced consumption of milling gas. The mill incorporates an impact plate in-line with a first jet and venturi and a second jet and venturi to entrain the milled particles from the plate to feed into a separation/milling chamber.

11 Claims, 1 Drawing Sheet

IMPROVED IMPACT PLATE GRINDING MILL HAVING REDUCED MILLING GAS CONSUMPTION

Figure 1:
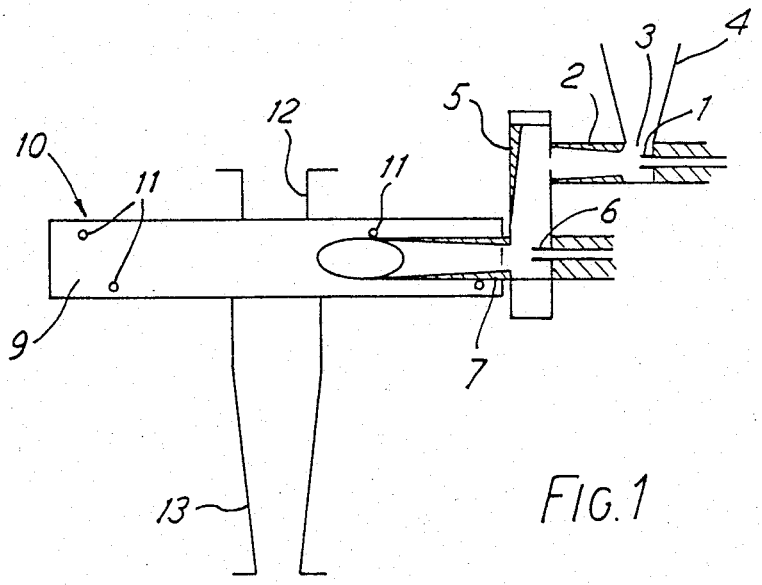

This invention relates to an improved mill and particularly to an improved impact mill.

According to the present invention a mill for grinding powder material comprises a powder inlet to provide powder material to be ground, a first jet nozzle for a gas, a first venturi axially in-line with said first jet nozzle and spaced therefrom by said powder inlet, an impact mill surface mounted at a reflective angle to the axis of said first jet and said first venturi, a second jet nozzle for a gas spaced from said impact mill surface and having a longitudinally axis transverse to the reflected line of the axis of said first jet and of said first venturi, a cylindrical separation chamber having a circumferential wall and having outlets for exhaust gas and powder material and feeding means extending through said circumferential wall comprising a second venturi axially in line with said second jet nozzle to introduce powder material into said cylindrical separation chamber.

Whilst the mill includes said cylindrical separation chamber it is to be understood that this chamber can also act as a fluid energy mill through impact of powder particles with one another and, if desired, additional gaseous material can be supplied to said chamber through one or more gas jets.

As will be seen the mill of the present invention is a combination of an impact mill with a second jet nozzle assembly which acts to entrain the impacted powder material reflected from the impact mill surface in a second gas stream and feed this stream to the separation chamber where additional milling can be effected. The presence of the second jet nozzle increases the flow of particulate material through the mill by reducing the pressure on the discharge or reflective side of the impact surface as a result of the effect of the second jet and associated second venturi.

The mill is of particular use in grinding powder material to a small controlled size range and particularly for those types of powders, such as pigments, where properties of the product can be changed according to the product size.

Inorganic pigments such as titanium dioxide, silica, silicates, aluminum oxide, antimony pigments, calcium pigments, carbon black, iron oxide, lead oxide, zinc oxide, zirconia are all suitable for grinding in the improved mill. Other materials such as organic coloured pigments and pharmaceuticals can be ground in the mill employing a suitable grinding gas.

The mill constructed in accordance with the invention can have any convenient chosen size so as to produce a desired rate of output of milled powder and accordingly is suitable in any particular chosen form for use as a laboratory mill or up to a full sized factory unit. The particular sizes of the first and second jet nozzles, first and second venturis and cylindrical chamber depend on the desired output of milled powder as does the rate of feed or grinding or carrier gas through the particular jet nozzles.

The first and second jet nozzles and associated venturi throats can have sizes chosen from within a wide size range and the gases fed through the first and second nozzles can be fed under a wide range of pressures chosen to match the particular jet sizes and product characteristics required. One particular form of preferred mill constructed in accordance with the invention has a ratio of throat area of the first venturi to the area of the first jet nozzle of about 11:1 and a ratio of the second venturi throat area to second jet area of about 16:1 for operation at 20 bars pressure.

Any suitable gas can be used to entrain and transport material to be milled through the mill. Steam or an inert gas can be used as can air. The gas can be heated if desired and in the case of steam the degree of super heat chosen governs the temperature of the gas employed. Generally speaking the gases fed to the first and second jet nozzles will have a pressure of at least 5 bars and preferably have a pressure of at least 10 bars.

It will be seen that separate supplies of gas are fed to the first and second nozzles and in a particular arrangement the rate of feed is such that the second nozzle is supplied with steam flowing at a rate of up to twice that flowing to the first nozzle.

If desired an additional supply of gas is introduced into the separation chamber through one or more inlets in the circumferential wall of the chamber. The total amount of gas fed to the separation chamber through these additional inlets through the circumferential wall can be substantially equal to that supplied to the mill through the first jet nozzle or less.

The mill in accordance with the present invention can be constructed of any appropriate material such as stainless steel or indeed the various parts of the particular mill can be formed of ceramic material if desired. An impact surface formed of suitable ceramic material is less liable to introduce unwanted contamination of the product by small amounts of iron.

Figure 2:
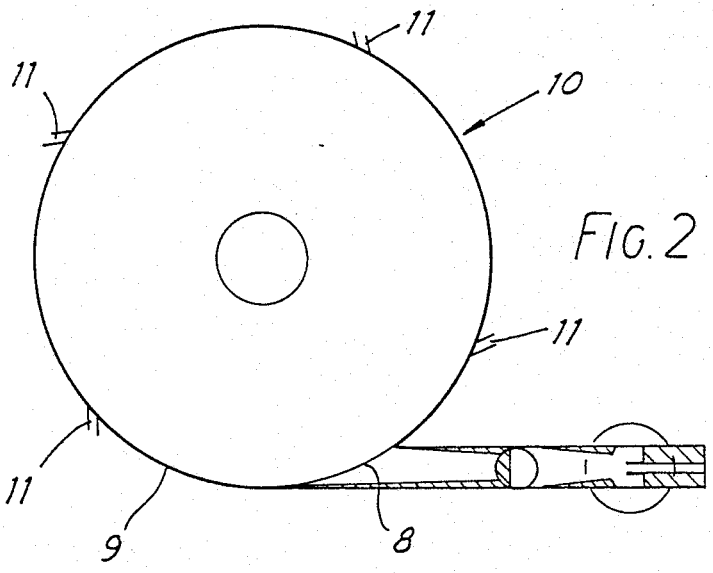

One form of mill constructed in accordance with the invention will now be described by way of example only with reference to the accompanying drawings in which FIG. 1 is a diagrammatic view showing part in sectional elevation and FIG. 2 is a part sectional plan view.

As shown in FIG. 1 the mill consists of a first jet nozzle 1 axially aligned but spaced from a first venturi 2. Between the nozzle 1 and venturi 2 is an inlet 3 for powder material from a hopper 4. An impact surface 5 is mounted to receive material from the venturi 2 and to reflect the milled powder towards a second jet nozzle 6 supplied from a second venturi 7 axially aligned with the jet nozzle 6. The second venturi 7 forms a powder feed device to feed powder through a powder inlet 8 in the wall 9 of a cylindrical chamber 10.

The cylindrical wall 9 of a cylinder chamber 10 is provided with a number of spaced gas inlets 11 directed to feed additional quantities of gas into the cylindrical chamber 10. The cylindrical chamber 10 is provided with a centrally located gas offtake 12 opposite an axially aligned milled powder offtake 13.

In operation the powder material to be ground is fed from hopper 4 through the feed inlet 3 and becomes entrained in gas supplied through jet nozzle 1. The gas together with the entrained material is fed through venturi 2 and directed on to the impact surface 5 where milling takes place due to impact with the surface prior to being reflected towards the second jet nozzle 6. Gas flowing from the second jet nozzle 6 entrains the material reflected from the impact surface 5 and due to the influence of the second venturi 7 a reduction in pressure occurs together with a positive increase in the rate of flow of the powdered material to be ground from hopper 4 on to the impact surface 5. The impacted material after entrainment and passage through the second venturi is fed substantially tangentially into an inlet of the cylindrical chamber 10 through the fed inlet 8 where additional supplies of gas are introduced through the gas inlet 11 augumenting the flow of gas within the chamber 10 and increasing the milling effect occurring therein due to impact of the particles with each other. As the gaseous fluid and milled particles are transported towards the central regions of the chamber 10 the speed of the flowing gas becomes insufficient to support the milled particles which exit the chamber through the particle offtake 13 and exhaust gas together with any very small particle size material exhaust through the gas exhaust 12.

The invention is illustrated in the following Example.

EXAMPLE

Steam at a pressure of 20 bars gauge was supplied to jet 1 of a mill constructed as shown in FIGS. 1 and 2 of the drawings and at a rate of 145 kg per hour. Unmilled titanium dioxide pigment was fed from hopper 4 through inlet 3 at a rate of 220 kg per hour into the stream of steam. Steam at a pressure of 16 bars gauge and at a rate of 190 kg per hour was fed to second jet 6. No steam was applied to the additional jets 11. The overall steam/pigment ratio was 1.5:1.

The milled produce was equivalent to that obtained by conventional double fluid energy milling at a steam/-pigment ratio of 3.2:1. The pressure measured at a point between the impact plate and the second jet 6 was approximately one-eighth that measured at the exit of the second venturi 7 clearly showing the effect of the second jet 6 on the pressure on the discharge side of the first jet 1.

I claim:

1. A mill for grinding powder material comprising a powder inlet to introduce powder material into a gas, a first jet nozzle for supplying said gas, a first venturi axially in-line with said first jet nozzle and spaced therefrom by said powder inlet, an impact mill surface mounted at a reflective angle to the axis of said first jet nozzle and said first venturi for altering the direction of flow of said powder material entrained in said gas, a second jet nozzle for a gas spaced from said impact mill surface and having a longitudinal axis transverse to the direction of the altered flow downstream from said impact mill surface, a cylindrical chamber having a circumferential wall and having outlets for exhaust gas and powder material and feeding means extending through said circumferential wall comprising a second venturi axially in line with said second jet nozzle to introduce powder material into said cylindrical chamber.

2. A mill according to claim 1 in which the ratio of the throat area of said first venturi to the area of said first jet nozzle is about 11:1.

3. A mill according to claim 1 in which the ratio of throat area of said second venturi to the area of said second jet nozzle is about 16:1.

4. A mill according to claim 1 in which said outlets for exhaust gas and powder material are located axially of said cylindrical chamber.

5. A mill according to claim 1 in which said cylindrical chamber is provided with one or more additional inlets in the circumferential wall of the chamber.

6. A mill according to claim 1 in which the mill is formed of stainless steel.

7. A method of milling a powder in a mill comprising a powder inlet to introduce powder material into a gas, a first jet nozzle for supplying said gas, a first venturi axially in-line with said first jet nozzle and spaced therefrom by said powder inlet, an impact mill surface mounted at a reflective angle to the axis of said first jet nozzle and said first venturi for altering the direction of flow of said powder material entrained in said gas, a second jet nozzle for a gas spaced from said impact mill surface and having a longitudinal axis transverse to the direction of the altered flow downstream from said impact mill surface, cylindrical chamber having a circumferential wall and having outlets for exhaust gas and powder material and feeding means extending through said circumferential wall comprising a second venturi axially in line with said second jet nozzle to introduce powder material into said cylindrical chamber which comprises passing a gas through said first jet and said first venturi while feeding a powder to be ground through said powder inlet to be entrained by said gas to impact on said impact mill surface and to be reflected therefrom, feeding a gas to said second jet nozzle and through said second venturi into said cylindrical chamber and to entrain powder material reflected from said impact mill surface and separating the milled powder from said gas and discharging said separated milled powder and said gas separately from said chamber.

8. A method according to claim 7 in which said gas is steam.

9. A method according to claim 7 in which the gas is fed to said first jet nozzle and said second jet nozzle at a pressure of at least 5 bars.

10. A method according to claim 9 in which said pressure is at least 10 bars.

11. A method according to any one of claims 7 to 10 in which the rate of feed of the gas to said second jet nozzle is up to twice that to said first jet nozzle.

* * * * *